US008632170B2

(12) United States Patent
Hayashi

(10) Patent No.: US 8,632,170 B2
(45) Date of Patent: Jan. 21, 2014

(54) LIQUID EJECTING HEAD

(75) Inventor: Hideki Hayashi, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 312 days.

(21) Appl. No.: 13/070,349

(22) Filed: Mar. 23, 2011

(65) Prior Publication Data

US 2011/0292130 A1 Dec. 1, 2011

(30) Foreign Application Priority Data

May 26, 2010 (JP) ..... 2010-120586

(51) Int. Cl.
*B41J 2/045* (2006.01)
*B41J 2/04* (2006.01)

(52) U.S. Cl.
USPC ..... 347/71; 347/54

(58) Field of Classification Search
None
See application file for complete search history.

(56) References Cited

U.S. PATENT DOCUMENTS 6,361,155 B1 3/2002 Kanda et al.
2002/0036678 A1 3/2002 Ito et al.
2004/0263583 A1 12/2004 Kanada et al.
2006/0024477 A1 2/2006 Ito
2006/0132551 A1* 6/2006 Chikamoto ..... 347/71

FOREIGN PATENT DOCUMENTS

JP 2001-063052 A 3/2001
JP 2002-096478 A 4/2002
JP 2004-358872 A 12/2004
JP 2005-022137 A 1/2005
JP 2005-319644 A 11/2005
JP 2007-320171 A 12/2007

OTHER PUBLICATIONS

Japan Patent Office, Notice of Reasons for Rejection for Japanese Patent Application No. 2010-120586 (counterpart Japanese patent application), mailed Sep. 11, 2012.
Japan Patent Office, Notice of Reasons for Rejection for Japanese Patent Application No. 2010-120586 (counterpart to above-captioned patent application), mailed Jun. 18, 2013.

* cited by examiner

*Primary Examiner* — Geoffrey Mruk
(74) *Attorney, Agent, or Firm* — Baker Botts L.L.P.

(57) ABSTRACT

A liquid ejecting head according to the present invention comprises a passage unit and an actuator unit. The passage unit includes a first opening and a plurality of second openings. One end of a dummy passage extends from and is connected to one or more third openings formed within a fix area of the actuator unit on a surface of a first plate, and an other end of the dummy passage is connected to one or more fourth openings formed on a surface of any of plates, via a space formed in a plate other than the first plate. The dummy passage is opened to the atmosphere through the one or more fourth openings.

10 Claims, 7 Drawing Sheets

LIQUID EJECTING HEAD

CROSS REFERENCE TO RELATED APPLICATION

This application claims priority from Japanese Patent Application No. 2010-120586, which was filed on May 26, 2010, the disclosure of which is herein incorporated by reference in its entirety.

BACKGROUND OF THE INVENTION

1. Field of the Invention

The present invention relates to a liquid ejecting head which ejects liquid such as ink or the like.

2. Description of Related Art

In an inkjet head which is an exemplary liquid ejecting head, a plurality of members forming the head are fixed to one another with a binder in some cases. When a binder is used, redundancy of the binder may move into ink passages of the head, thus deteriorating the ink ejection performance of the ejection openings. The ink ejection performance means the ejection speed, the ejection direction, the size of ink droplets ejected, or the like. For example, when the redundant binder moves into the ink passages corresponding to some of the ejection openings, the ink ejection performance becomes uneven among the ejection openings.

SUMMARY OF THE INVENTION

A possible approach for reducing the above problem is to form a groove or the like on the member to which the redundant binder is released.

There are various forms of actuators which apply ejection energy to ink inside a pressure chamber, including one structured by a thin sheet functioning as a common electrode and an individual electrode disposed to face that thin sheet over a space. For example, there is an actuator unit which is fixed, with a binder, to the surface of the passage unit having ink passages including pressure chambers, the surface having thereon openings of the pressure chambers.

When an actuator unit is fixed to a surface of a passage unit with a binder, the redundant binder may move not only into the pressure chambers but also to the side and the surface of the actuator unit. This binds the actuator unit and may cause a problem in driving the actuator unit.

An object of the present invention is to provide a liquid ejecting head in which redundancy of a binder applied between an actuator unit and a passage unit is restrained from moving into the pressure chamber or to the side or the surface of the actuator unit.

An aspect of the present invention is a liquid ejecting head comprising a passage unit and an actuator unit. The passage unit includes: a plurality of liquid passages each of which contains a first opening for ejecting liquid and a pressure chamber connected to the first opening; and a surface having a plurality of second openings by which the pressure chambers are exposed. The actuator unit is fixed to the surface of the passage unit with a binder and covers the second openings. The actuator unit contains a plurality of actuators which face the second openings and apply ejection energy to the liquid inside the pressure chambers, respectively. The passage unit includes a plurality of plates which are stacked one another and have holes structuring the liquid passages. Of the plates, a first plate having the surface and at least another plate adjacent to the first plate have a dummy passage which is not in communication with the liquid passages. The dummy passage extends from one or more third openings formed within a fix area of the actuator unit on the surface of the first plate to one or more fourth openings formed on a surface of any of the plates, via a space formed in a plate other than the first plate. The dummy passage is opened to the atmosphere through the one or more fourth openings.

BRIEF DESCRIPTION OF THE DRAWINGS

Other and further objects, features and advantages of the invention will appear more fully from the following description taken in connection with the accompanying drawings in which.

DESCRIPTION OF THE PREFERRED EMBODIMENTS

The following describes a preferable embodiment of the present invention, with reference to the attached drawings.

Figure 1:
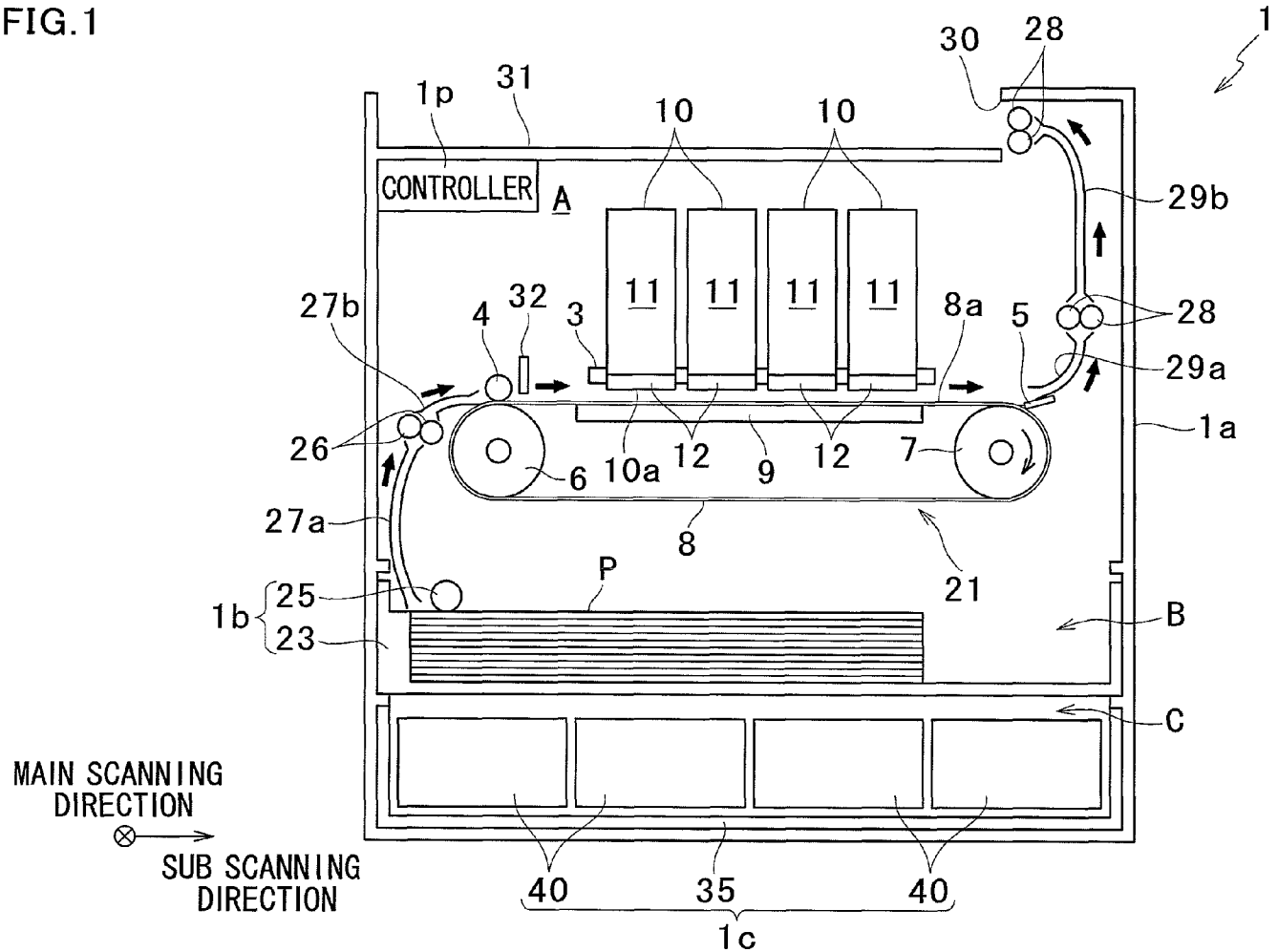
FIG. 1 is a schematic side view showing an interior structure of an inkjet printer having an inkjet head, according to one embodiment of the present invention.

First, the following describes, with reference to FIG. 1, an overall structure of an inkjet printer 1 including an inkjet head 10 according to one embodiment of the present invention.

The printer 1 has a casing 1*a* having a rectangular parallelepiped shape. On top of the ceiling plate of the casing 1*a* is a sheet output unit 31. The space inside the casing 1*a* is divided into spaces A, B, and C in this order from the top. The spaces A and B are spaces having a sheet conveyance path connecting to a sheet output unit 31. In the space A, a paper sheet P is conveyed and is subjected to image formation. In the space B is performed an operation related to paper sheet feeding. The space C accommodates therein ink cartridges 40 each of which serves as an ink supply source.

In the space A are disposed four inkjet heads 10, a conveyance unit 21 which conveys a paper sheet P, a later-mentioned guide unit which guides the paper sheet P, and the like. In the upper part of the space A is disposed a controller 1*p*. The controller 1*p* controls operations of parts of the printer 1 having these structures, and thereby administrates the entire operation of the printer 1.

To form an image on a paper sheet P based on image data supplied from the outside, the controller 1*p* controls an operation related to preparation for image formation; operations of supplying, conveying, and outputting the paper sheet P; and an operation of ejecting ink in sync with the conveyance of the paper sheet P.

Each head 10 is longer in the main scanning direction (in a direction perpendicular to the paper sheet surface of FIG. 1). The outline of each head 10 is substantially in a rectangular parallelepiped shape. The four heads 10 are aligned at a predetermined pitch in a sub scanning direction, and are supported by the casing 1*a* through a head frame 3. In formation of an image, the four heads 10 eject from their under surfaces (ejection faces 10*a*) ink of Magenta, Cyan, Yellow, and Black, respectively. The specific structure of each head 10 is detailed later.

As shown in FIG. 1, the conveyance unit 21 has belt rollers 6 and 7, and an endless conveyor belt 8 looped around the both rollers 6 and 7. In addition to those, the conveyance unit 21 has a nip roller 4 and a separation plate 5 disposed outside loop formed by the conveyor belt 8, and a platen 9 disposed inside the loop formed by the conveyor belt 8.

The belt roller 7 is a drive roller whose rotation is driven by a not-shown conveyance motor, and rotates clockwise in FIG. 1. With the rotation of the belt roller 7, the conveyor belt 8 runs in a direction indicated by the bold arrow in FIG. 1. The belt roller 6 is a driven roller, which rotates clockwise in FIG. 1, with the movement of the conveyor belt 8. The nip roller 4 is disposed to face the belt roller 6, and presses a paper sheet P supplied from a later-mentioned upstream guide unit against an outer circumference 8*a* of the conveyor belt 8. The separation plate 5 is disposed to face the belt roller 7. The separation plate 5 separates the paper sheet P from the outer circumference 8*a* and leads the paper sheet P to a downstream guide unit. The platen 9 is disposed to face the four heads 10 over the conveyance belt 8, and supports the upper part of the loop of the conveyor belt 8 from inside the loop. This forms a predetermined space suitable for image formation between the ejection faces 10*a* of the heads 10 and the outer circumference 8*a*.

The guide unit includes the upstream guide unit and the downstream guide unit which are disposed to sandwich the conveyance unit 21. The upstream guide unit has two guides 27*a* and 27*b* and a pair of feed rollers 26. The guide unit connects a later-mentioned sheet-feeder unit 1*b* with the conveyance unit 21. The downstream guide unit has two guides 29*a* and 29*b* and two pairs of feed rollers 28. The guide unit connects the conveyance unit 21 and the sheet output unit 31.

In the space B is disposed a sheet-feeder unit 1*b*. The sheet-feeder unit 1*b* has a sheet-feeder tray 23 and a sheet-feeder roller 25. The sheet-feeder tray 23 is detachable from the casing 1*a*. The sheet-feeder tray 23 is a box with an opened top, and capable of storing paper sheets P of various sizes. The sheet-feeder roller 25 feeds out the uppermost one of the paper sheets P in the sheet-feeder tray 23, and supply that upper most paper sheet P to the upstream guide unit.

As mentioned above, the sheet conveyance path extending from the sheet-feeder unit 1*b* to the sheet output unit 31 via the conveyance unit 21 is formed in the spaces A and B. The paper sheet P, having been feeded out from the sheet-feeder tray 23 based on a record instruction, is supplied to the conveyance unit 21 via the upstream guide unit. When the paper sheet P passes immediately below the heads 10 in the sub scanning direction, the ejection faces 10*a* successively eject ink to form a color image on the paper sheet P. The paper sheet P is further conveyed through the downstream guide unit, and is output to the sheet output unit 31 from an opening 30 disposed above.

Note that the sub scanning direction is a direction parallel to the conveyance direction of the paper sheet P by the conveyance unit 21. The main scanning direction is a direction which is parallel to a horizontal plane, and perpendicular to the sub scanning direction.

In the space C is disposed an ink unit 1*c*. The ink unit 1*c* is detachable from the casing 1*a*. The ink unit 1*c* includes a cartridge tray 35, and four cartridges 40 which are accommodated and aligned in the tray 35. Each cartridge 40 supplies ink to the corresponding one of the heads 10 via a not-shown ink tube.

Figure 2:
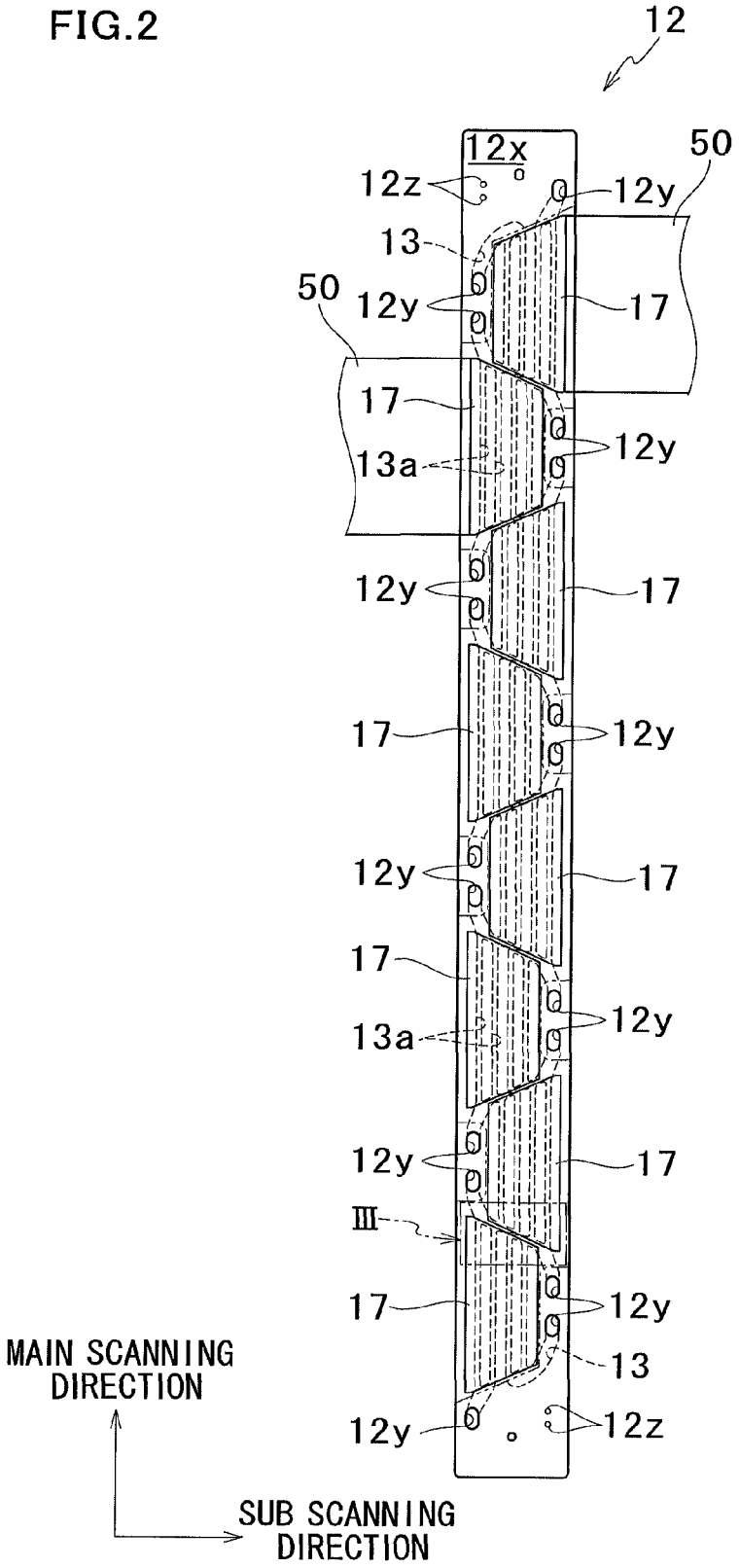
FIG. 2 is a plan view showing a passage unit and an actuator unit of the inkjet head.
Figure 3:
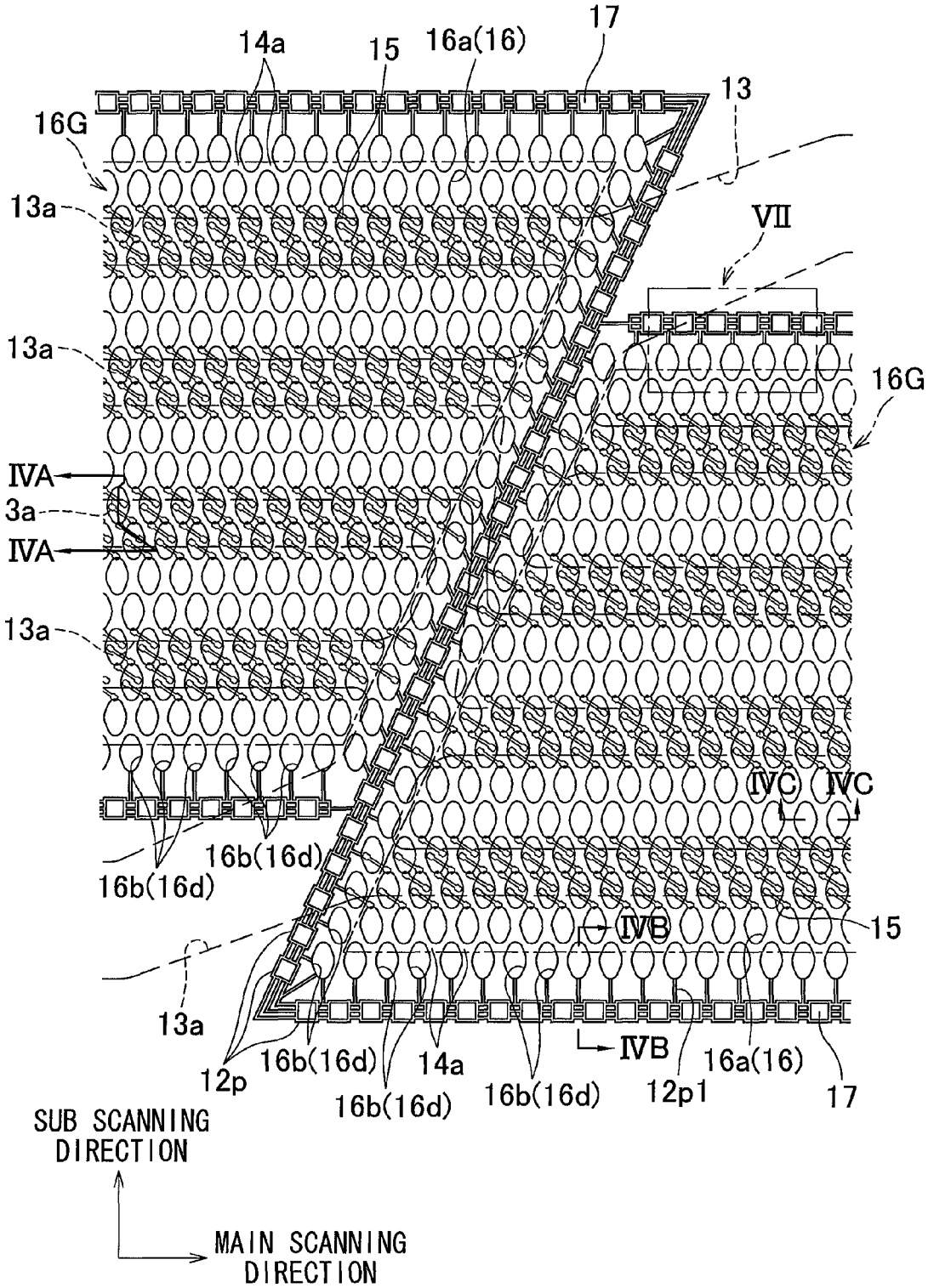
FIG. 3 is an enlarged view of an area III surrounded by a dotted line in FIG. 2.

Next, the following details the head 10 with reference to FIG. 2 to FIG. 5. Note that FIG. 3 illustrates, in solid lines, apertures 15, pressure chambers 16, openings 16*a*, openings 16*b* of dummy pressure chambers 16*d*, and the like which are under actuator units 17, although these members should be illustrated in dotted lines.

Figure 5:
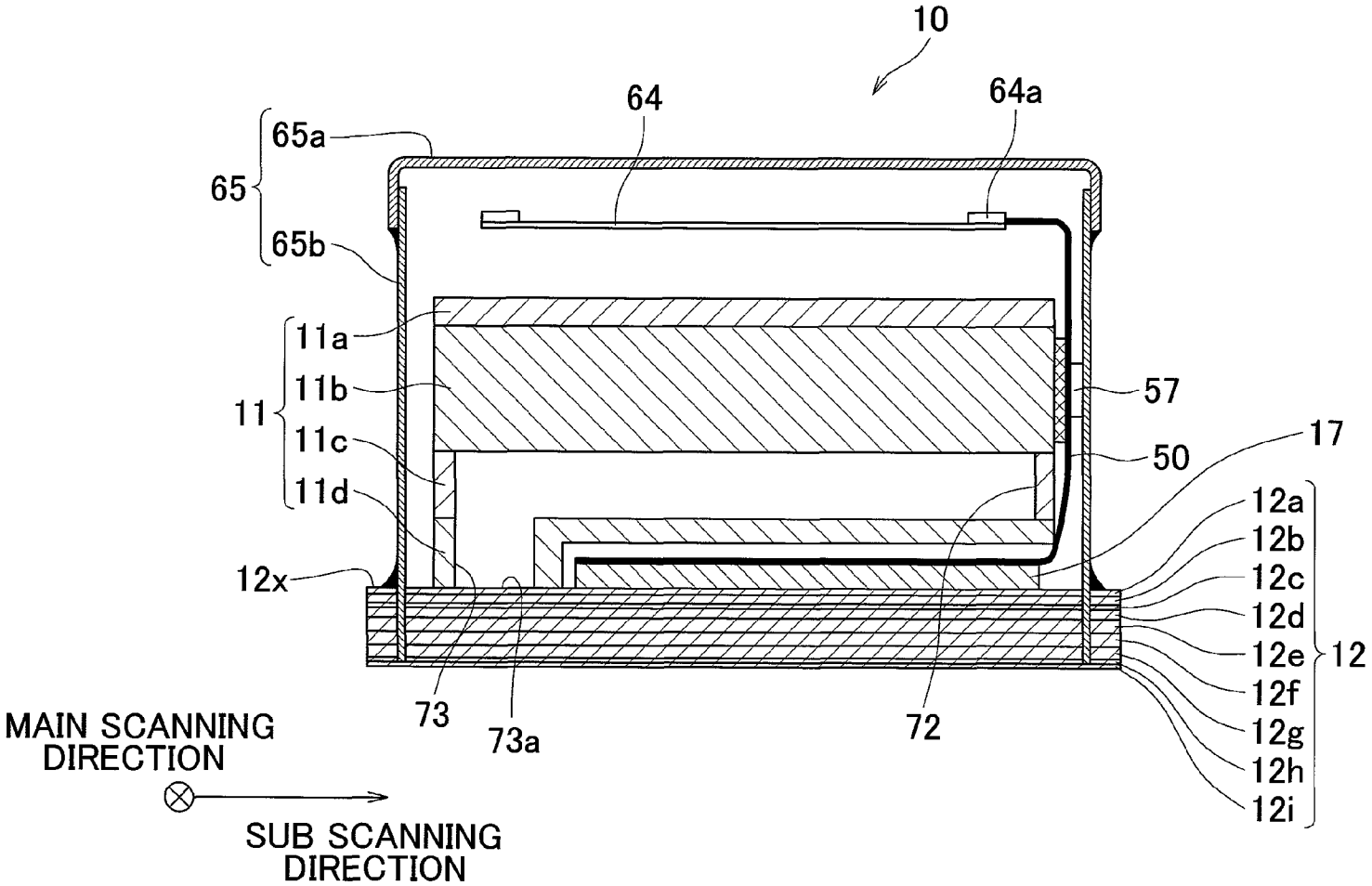
FIG. 5 is a longitudinal cross sectional view of the inkjet head.

As shown in FIG. 5, each head 10 is a layered member in which a passage unit 12, the actuator units 17, a reservoir unit 11, and a substrate 64 are stacked. Of these layers, the actuator units 17, the reservoir unit 11, and the substrate 64 are accommodated in a space formed by the top surface 12*x* of the passage unit 12 and the cover 65. In this space, each of the actuator units 17 and the substrate 64 are electrically connected to each other via an FPC (Flexible Printed Circuit Board) 50. On the FPC 50 is mounted a driver IC 57.

As shown in FIG. 5, the cover 65 includes a top cover 65*a* and a side cover 65*b*. The cover 65 is a box with an opened bottom. This cover 65 is fixed to the top surface 12*x* of the passage unit 12. The side cover 65*b* is an aluminum plate, and also function as a heat sink. The driver IC 57 abuts the inner surface of the side cover 65*b*, and is thermally jointed to the cover 65*b*.

The reservoir unit 11 is a layered member in which four metal plates 11*a* to 11*d* each having a through hole or a recess are stacked one another. Inside the reservoir unit 11 is formed an ink passage including a reservoir 72. One end of the ink passage is connected to the cartridge 40 via a tube or the like, and the other end is opened to the under surface of the reservoir unit 11. On the plate 11*d* are formed ink outflow passages 73 each of which is a part of ink passage in the reservoir unit 11 and is in communication with the reservoir 72. Each of the passages 73 leads to an opening on the surface of the leading end of a protrusion on the under surface of the plate 11*d*; i.e., to the surface to be jointed to the top surface 12*x*.

Figure 4A:
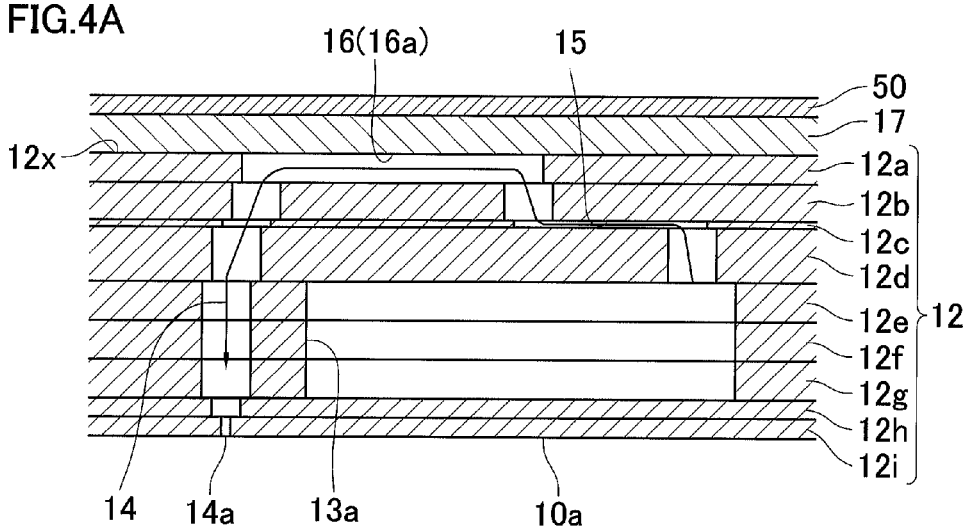
FIG. 4A is a cross sectional view taken along the line IVA-IVA in FIG. 3.

The passage unit 12 is a layered member in which nine rectangular metal plates 12*a* to 12*i* (see FIG. 4A) having substantially the same sizes are stacked one another. As shown in FIG. 2, on the top surface 12*x* of the passage unit 12 are formed openings 12*y* which face the openings 73*a* of the ink outflow passages 73, respectively. Inside the passage unit 12 are formed ink passages each extending from one of the openings 12*y* to ejection openings 14*a*; later-mentioned dummy passages 14*d* and later-mentioned inspection passages 14*c* which are not in communication with the ink passages. As shown in FIG. 2, FIG. 3, and FIG. 4A, each ink passage includes a manifold channel 13 having the opening 12*y* at one end, sub manifold channels 13*a* branched off from the manifold channel 13, and individual passages 14 extending from the outlet of the sub manifold channels 13*a* to the ejection openings 14*a* via pressure chambers 16.

As shown in FIG. 2 and FIG. 3, the manifold channel 13 and the sub manifold channels 13*a* are passages shared by a plurality of ejection openings 14*a*. The individual passages 14 on the other hand are provided for the ejection openings 14*a*, on one-to-one basis. As shown in FIG. 4A, each of the individual passages 14 includes an aperture 15 having a function of adjusting passage resistance, and a pressure chamber 16 which is opened to the top surface 12*x*. As shown in FIG. 3, the respective openings 16*a* of the pressure chambers 16 formed on the top surface 12*x* are substantially in the shape of a diamond, and are disposed in a matrix to structure eight opening groups 16G each occupying substantially a trapezoid area in plan view. These opening groups 16G are disposed in two lines in a zigzag manner, on the top surface 12*x*. Similarly, the ejection openings 14*a* formed on the ejection face 10*a* are disposed in a matrix as is the case of the openings 16*a*, thereby structuring a total of eight ejection opening groups each occupying substantially a trapezoid area in plan view.

Here, the ejection opening 14*a* serves as the first opening, and the opening 16*a* serves as the second opening.

As shown in FIG. 2, each actuator unit 17 has a trapezoid plane, and is disposed on the trapezoid area on the opening group 16G. The actuator unit 17 has its trapezoid base side close to a side of the passage unit 12 relative to the sub scanning direction. The actuator unit 17 is disposed within a gap created by the reservoir unit 11 and the passage unit 12 while avoiding the protrusion on the under surface of the reservoir unit.

The FPC 50 is provided to each of the actuator unit 17, and wiring corresponding to the electrodes of the actuator unit 17 is connected to the output terminal of the driver IC 57. Under control of the controller 1*p* (see FIG. 1), the FPC 50 communicates various drive signals adjusted in the substrate 64 (see FIG. 5) to the driver IC 57, and communicates various drive voltage generated by the driver IC 57 to the actuator unit 17.

Next, the following describes the actuator unit 17, with reference to FIG. 6.

Figure 6A:
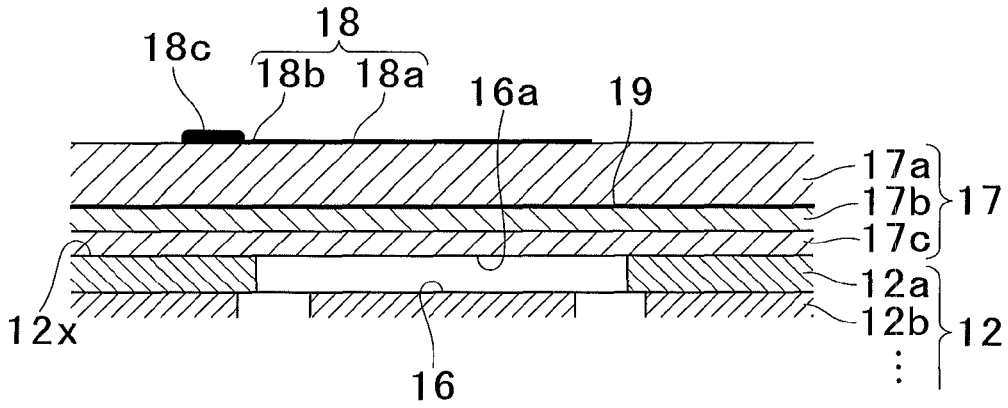
FIG. 6A is a partial enlarged cross sectional view of the actuator unit.

As shown in FIG. 6A, the actuator unit 17 has a layered member of two piezoelectric layers 17*a* and 17*b*, and an oscillation plate 17*c* disposed between the layered member and the passage unit 12. The piezoelectric layers 17*a* and 17*b* and the oscillation plate 17*c* are all sheet members made of a ceramic material based on a ferroelectric lead zirconate titanate (PZT). The piezoelectric layer 17*a* is polarized in thickness directions thereof.

The piezoelectric layers 17*a* and 17*b* and the oscillation plate 17*c* are all the same in size and shape (a trapezoid shape defining the shape of each actuator unit 17). That is, the piezoelectric layers 17*a* and 17*b* and the oscillation plate 17*c* are extended over the openings 16*a* in one of the opening groups 16G, and cover the entire trapezoid area of that opening group 16G. All of the openings 16*a* in the opening group 16G are therefore closed by the oscillation plate 17*c*.

On the top surface of the piezoelectric layer 17*a* is formed a number of individual electrodes 18 corresponding to the pressure chambers 16 respectively. Between the piezoelectric layer 17*a* and the piezoelectric layer 17*b* therebelow is a common electrode 19. No electrode is formed on the oscillation plate 17*c*.

Figure 6B:
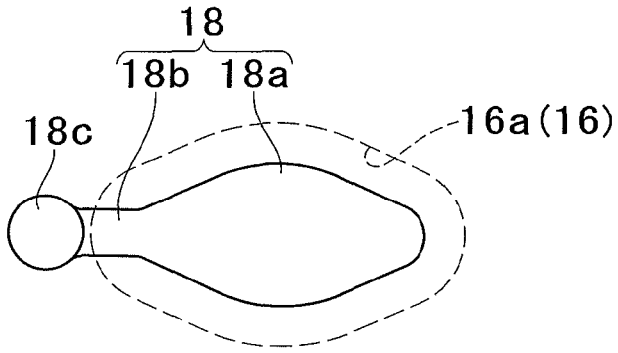
FIG. 6B is a plan view showing individual electrodes of the actuator unit.

As shown in FIG. 6B, each individual electrode 18 includes a main electrode area 18*a* substantially in the shape of diamond, an extended portion 18*b* extended from one of sharp angle portions of the main electrode area 18*a*, and a land 18*c* formed on the extended portion 18*b*. The main electrode area 18*a* has a shape which resembles to that of the opening 16*a*, and is disposed within the opening 16*a* in plan view. The extended portion 18*b* is extended to the outside area of the opening 16*a*, and the land 18*c* is disposed on the leading end. The land 18*c* has a circular outline in plan view, and does not face the opening 16*a*. Further, the land 18*c* has a height of approximately 50 μm from the top surface of the piezoelectric layer 17*a*, and is electrically connected to a terminal of the wiring of the FPC 50.

The common electrode 19 is formed throughout the entire piezoelectric layer 17*b*. The common electrode 19 is electrically connected to a not-shown land for the common electrode formed on the top surface of the piezoelectric layer 17*a*. The land for the common electrode is disposed nearby each corner of the trapezoid on the top surface of the piezoelectric layer 17*a*, and is connected to the terminal of the FPC 50. The potential of this land is always kept at the ground level (0V).

The portion of the piezoelectric layer 17*a* sandwiched between the electrodes 18 and 19 serves as an active portion which, upon application of an electric field in thickness directions, contracts in in-plane directions due to a transversal piezoelectric effect. When the potential of the individual electrode 18 is made different from that of the common electrode 19, the active portion contracts in in-plane directions due to a transversal piezoelectric effect. Since the other layers (layers 17*b* and 17*c* other than the piezoelectric layer 17*a*) are not spontaneously displaced, there will be a difference in the level of deformation between these layers and the active portion. Due to the difference, in the actuator unit 17, the portion facing the opening 16*a* is deformed in a convex shape towards inside the pressure chamber 16 (unimorph deformation), thus applying ejection energy to the ink inside the pressure chamber 16. The portion facing the opening 16*a* of the actuator unit 17 is a piezoelectric actuator, which is provided for each of the pressure chambers 16, and is deformed independently of those of the other pressure chambers 16.

Next, the following describes the dummy passages 14*d*.

Figure 4B:
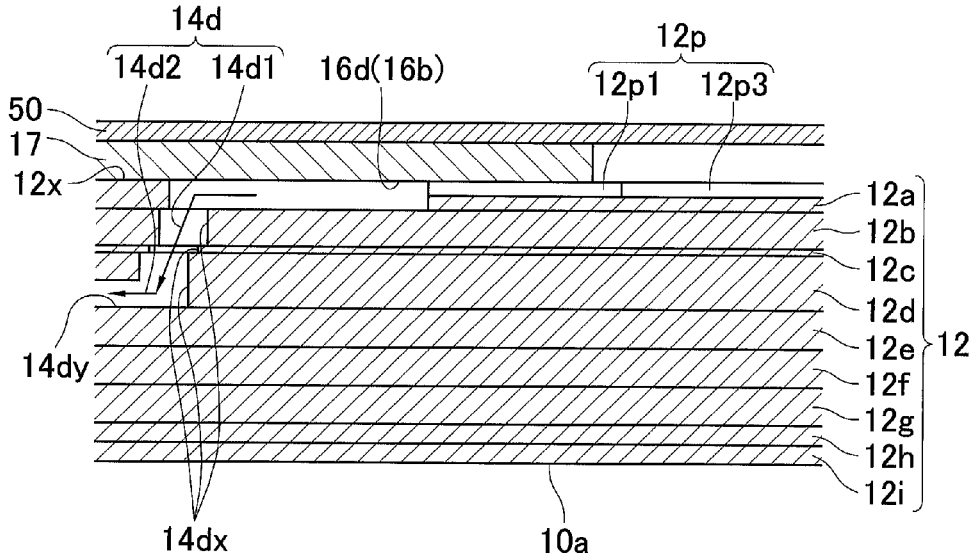
FIG. 4B is a cross sectional view taken along the line IVB-IVB in FIG. 3.

As shown in FIG. 4B, each of the dummy passages 14*d* is formed on the top four plates 12*a* to 12*d* among the plates 12*a* to 12*i* forming the passage unit 12. The plates 12*a*, 12*b*, 12*c*, and 12*d* are, for example, 80 μm, 100 μm, 20 μm, and 150 μm in thickness, respectively. That is, the plate 12*d* is the thickest among the plates 12*a* to 12*d*.

Each dummy passage 14*d* extends from a dummy pressure chamber 16*d* formed on the cavity plate 12*a* at the uppermost layer to one of openings 12*z* (see FIG. 2) formed on the top surface 12*x*, via a through hole 14*dx* penetrating the plates 12*b* to 12*d*, and a recess 14*dy* formed on the under surface of the supply plate 12*d*. As shown in FIG. 2, there are four openings 12*z* on the top surface 12*x* of the passage unit 12; two of which are formed on one end and another two formed on the other end of the top surface 12*x* relative to the main scanning direction. All of the opening groups 16G are sandwiched between the openings 12*z* relative to the main scanning direction.

The dummy pressure chamber 16*d* is structured by a through hole penetrating the plate 12*a* in the thickness directions. As shown in FIG. 3, the plate 12*a* has the openings 16*b* of the dummy pressure chambers 16*d*, within a fix area of each actuator unit 17 on the surface of the plate 12*a* (top surface 12*x*). These openings 16*b* surround the opening group 16G along a periphery of the fix area (along the four sides of the trapezoid). The openings 16*b* each has the same size and shape as those of the opening 16*a*, and are positioned in the same pattern as the openings 16*a*.

Here, the opening 16*b* serves as the third opening, and the opening 12*z* serves as the fourth opening.

The dummy passage 14*d* is formed for each dummy pressure chamber 16*d*. The dummy passage 14*d* is structured by partial passages 14*d*1 and 14*d*2, and a not-shown partial passage connecting the leading end of the partial passage 14*d*2 and the opening 12*z*. The partial passage 14*d*1 is structure by three through holes 14*dx*. The partial passage 14*d*2 is mainly the recess 14*dy*, and has one end connected to the through hole 14*dx* of the plate 12*d* and another end nearby the corresponding one of the openings 12*z*. The other end of the recess 14*dy* is connected to one of the openings 12*z* via a not-shown through hole (a through hole formed through the plates 12*a* to 12*d*) or the like.

Next, a groove 12*p* is described.

The groove 12*p* is structured by a recess formed on the surface (top surface 12*x*) of the plate 12*a*. The groove 12*p* is provided further outward than the dummy pressure chambers 16*d*. The groove 12*p* in plan view has a shape such that a plurality of grids are connected to one another via long lines. The groove 12*p* surrounds the actuator unit 17 along the periphery of the fix area (along four sides of the trapezoid), and covers the boundary of the fix area of the actuator unit 17.

Figure 7:
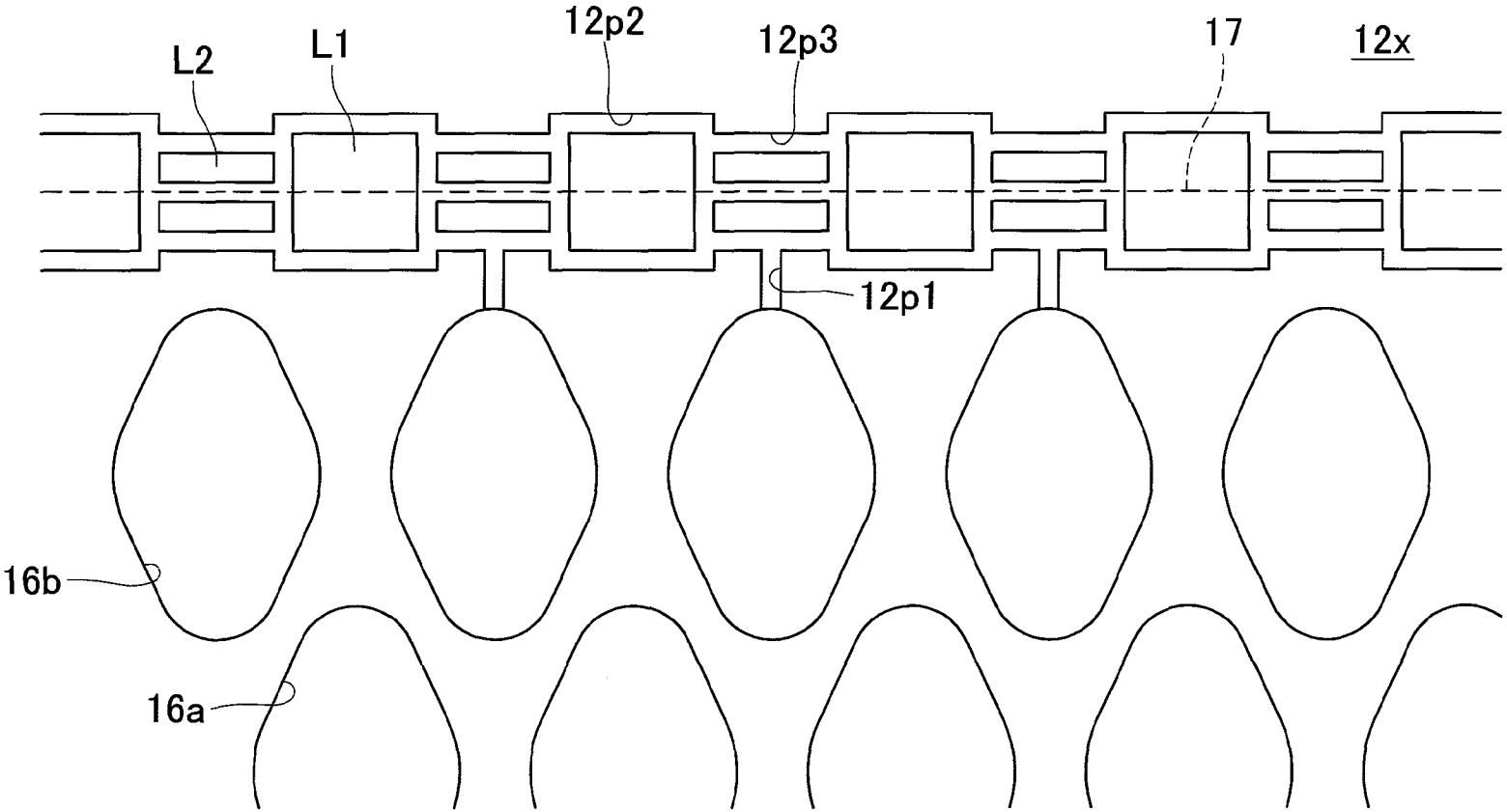
FIG. 7 is an enlarged view showing an area VII surrounded by a double-dashed line in FIG. 3.

As shown in FIG. 7, the groove 12*p* has connect portions 12*p*1 and 12*p*3 and grid portions 12*p*2. Each of the connect portions 12*p*1 is a linear groove, whose one end is connected to the opening 16*b*. The grid portion 12*p*2 is a groove forming a quadrangular outline, and defines a quadrangular island L1. A number of islands L1 are aligned along the sides of the actuator unit 17 at regular intervals. The border line of the actuator unit 17 (broken line in FIG. 7) is in the middle of the islands L1. Each of the connect portions 12*p*3 is a linear groove and connects the grid portions 12*p*2 one another. There are three connect portions 12*p*3 which connect adjacent grid portions 12*p*2, and these three connect portions 12*p*3 and the grid portions 12*p*2 defines rectangular islands L2. The border line of the actuator unit 17 is in the middle of one of the connect portions 12*p*3 between the two islands L2. As shown in FIG. 7, the connect portions 12*p*3 and the grid portions 12*p*2 are partially outside the actuator unit 17 in plan view, and are in communication with the atmosphere. Thus, the openings 16*b* are in communication with the atmosphere through the groove 12P.

The islands L1 and L2 adjust the amount of binder moving inside the border line of the actuator unit 17, while supporting the actuator unit 17 from the bottom to prevent damages to the side of the actuator unit 17.

Next, the inspection passages 14*c* are described. Each of the inspection passages 14*c* is used for inspecting a leakage from the individual passages 14.

Figure 4C:
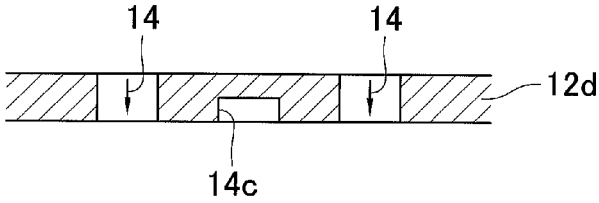
FIG. 4C is a cross sectional view taken along the line IVC-IVC in FIG. 3.

As shown in FIG. 4C, the inspection passage 14*c* is structured by a recess formed on the under surface of the plate 12*d*, and is disposed between adjacent individual passages 14. The inspection passage 14*c* extends along the under surface of the plate 12*d*. The inspection passage 14*c* is not in communication with the individual passages 14. The inspection passage 14*c* however is connected to the recess 14*dy* at a not-illustrated position and therefore is in communication with the dummy passage 14*d*.

As described above, with the head 10 of the present embodiment, redundancy of the binder applied between the actuator unit 17 and the passage unit 12 is received by the openings 16*b* each of which is one end of a dummy passage 14*d*. The dummy passage 14*d* has another end which is opened to the atmosphere through the opening 12*z*. Therefore, the redundant binder more likely moves into the openings 16*b*. Thus, it is possible to restrain the redundant binder from moving into the pressure chambers 16 or to the side or the surface (the surface opposite to the surface facing the passage unit 12) of the actuator unit 17.

Further, the structure of the present embodiment allows inspection of leakage between the individual passage 14 and the dummy passage 14*d*. Specifically, for example, the entire ejection face 10*a* (all of the ejection openings 14*a* formed on the ejection face 10*a*) is covered by a not-shown cap. Then, the inside of the cap is depressurized. Then, the pressure inside the cap is measured. If the plates 12*a* to 12*d* are well fixed to one another, the individual passages 14 and the dummy passages 14*d* are not in communication. Therefore, the pressure inside the cap remains depressurized. However, if the individual passages 14 and the dummy passages 14*d* are partially in communication due to defective fixing caused by the presence of a space or foreign materials between the plates 12*a* to 12*d*, the pressure inside the cap becomes the atmospheric pressure after the depressurization, because the dummy passages 14*d* are opened to the atmosphere. Inspecting such a leakage improves the quality of the head 10.

As shown in FIG. 3, the openings 16*b* are positioned along the periphery of the fix area of each actuator unit 17, outside the opening group 16G constituted by the openings 16*a* formed within the fix area. This more effectively restrains the redundant binder from moving to the side or the surface of the actuator unit 17.

As shown in FIG. 3, the openings 16*b* surround the opening group 16G along the periphery of the fix area of the actuator unit 17. This restrains movement of the redundant binder to the side or the surface of the actuator unit 17, throughout the entire periphery of the actuator unit 17. Further, it is possible to restrain the difference in the amount of redundant binder moving into the pressure chamber 16 between the openings 16*a* nearby the periphery of the fix area and the openings 16*a* inside the fix area. This uniformalizes the respective deformabilities of the piezoelectric actuators in the actuator unit 17, thus improving the recording quality.

As shown in FIG. 3, the openings 16*b* have the same size and shape as those of the opening 16*a*. Further, the openings 16*b* are positioned in the same pattern as the openings 16*a*. That is, any one of the openings 16*b* and the other openings 16*a* and 16*b* around that one opening 16*b* have the same positional relation as the positional relation among the openings 16*a* in the opening group 16G. The above structure enables easier manufacturing of the passage unit 12, and reliably brings about the above-mentioned effect: i.e., to restrain movement of the redundant binder to the side or the surface of the actuator unit 17 throughout the entire periphery of the actuator unit 17; and to restrain the difference in the amount of redundant binder moving into the pressure chamber 16 between the openings 16*a* nearby the periphery of the fix area and the openings 16*a* inside the fix area. Further, the above arrangement of the openings 16*b* uniformalizes the hardness of the area around each pressure chamber 16 of the opening group 16G on the passage unit 12, thus equalizing the ink ejection characteristics of the ejection openings 14*a* included in the group 16G.

The passage unit 12 includes the inspection passage 14*c* (see FIG. 4C). The inspection passage 14*c* is positioned between the individual passages 14, and is not in communication with the individual passages 14 while being in communication with the dummy passage 14*d*. With the provision of the inspection passage 14*c*, it is possible to inspect not only the leakage between the individual passage 14 and the dummy passage 14*d*, but also the leakage between the individual passages 14. In other words, when the leakage between the individual passage 14 and the dummy passage 14*d* is inspected, the leakage between the individual passages 14 is inspected at the same time. Since a single inspection process of leakage enables both of inspection of the leakage between the individual passage 14 and the dummy passage 14*d*, and inspection of the leakage between the individual passages 14, the number of processes is reduced. Thus, the head 10 with an improved quality is realized at the low costs.

The openings 12*z* sandwich the individual passages 14 formed in the passage unit 12 in plan view, as shown in FIG. 2. For example, when a leakage is detected in the inspection, the part where the leakage has occurred is confirmed by, for example, supplying a colored ink from the opening 12*z* on one side to the opening 12*z* on the other side; e.g., from the two openings 12*z* at the upper part of the FIG. 2 to the two openings 12*z* at the lower part of the FIG. 2.

As shown in FIG. 4B, the dummy passage 14*d* includes: the partial passage 14*d*1 extending from the opening 16*b* through the through hole 14*dx* penetrating the plates 12*a* to 12*d*; and the partial passage 14*d*2 including the recess 14*dy*, which extends along the under surface of the plate 12*d*. The partial passage 14*d*2 is formed on the surface of the plate 12*d* which is the thickest plate among the plates 12*a* to 12*d* forming the partial passage 14*d*1. Therefore, formation of the partial passage 14*d*2 is easy, and a relatively large volume is easily ensured for the partial passage 14*d*2. Further, thanks to the large volume, even when the plate 12*d* is stacked to the other plates 12*c* and 12*e* with a binder, the partial passage 14*d*2 is hardly clogged by the binder.

When a layered member having a plurality of plates is manufactured, a binder is usually applied to the respective under surfaces of the plates except for the lowermost plate, and the plates are fixed to one another while positioning each plate. In the present embodiment, the recess 14*dy* is formed on the under surface of the plate 12*c*1, and not on the top surface thereof. This facilitates redundancy of the binder applied on the under surface (the binder for fixing the plate 12*d* to the plate 12*e*) to easily move into the partial passages 14*d*2. Further, to form the partial passage 14*d*2 (recess 14*dy*) by etching, formation of a recess with a large volume is easier on the under surface than the top surface of a plate, due to the structure of the etching process or apparatus. In this case too, the present embodiment is advantageous, because formation of a partial passage 14*d*2 with a relatively large volume is possible on the under surface of the plate 12*d*.

Further, with the groove 12*p*, the redundant binder at the periphery of the actuator unit 17 is released. Therefore, movement of the redundant binder to the side or the surface of the actuator unit 17 is effectively restrained.

The structure (shape, size, arrangement, and the like) of the groove 12*p* is not particularly limited, and may be modified to any structure. Further, it is possible to omit the groove 12*p*.

The inspection passage 14*c* may be formed in any shape on any plate structuring the passage unit 12. Further, it is possible to omit the inspection passage 14*c*.

The partial passage 14*d*2 (recess 14*dy*) may be formed on the top surface of the plate 12*d* or on the surface of a plate other than the plate 12*d* which is the thickest among the plates 12*a* to 12*d* in which the partial passage 14*d*1 is formed.

The dummy passage 14*d* may be formed on any one of the plates structuring the passage unit 12, including the two plates at the top (e.g. on the top two or three plates, or on all of the plates, or the like). Further, the space created by the dummy passage 14*d* is not particularly limited, provided that the space extends from the third opening(s) to the fourth opening (s) via a space formed in any of the plates structuring the passage unit 12 other than the first plate having the third opening(s). In the present embodiment, the above space is structured by the recess 14*dy* formed on the under surface of the plate 12*d*. However, the space may be formed on the surface of or inside any of the plates 12*b* to 12*i*; i.e., on any of the plates except the plate 12*a*.

The position of the fourth opening is on a plate structuring the passage unit, and is not particularly limited as long as the fourth opening is in communication with the atmosphere. For example, instead of forming the fourth opening on the surface (top surface 12*x*) of the plate 12*a* at the uppermost layer, the fourth opening may be formed on a side face of any of the plates 12*a* to 12*i*, or on the under surface (ejection face 10*a*) of the plate 12*i* at the lowermost layer. In such a case however, it is preferable to provide a recess or the like at a portion of the dummy passage nearby the fourth opening, for the purpose of preventing leakage of the binder from the fourth opening.

The above embodiment deals with a case where a plurality of fourth openings (the openings 12*z*) sandwich, in plan view, all of the individual passages 14 formed in the passage unit 12. The positions of the fourth openings however is not limited to such positions. For example, the fourth openings may be formed only one side of the passage unit 12 relative to the main scanning direction. Further, it is not necessary to provide a plurality of fourth openings, i.e., a single fourth opening is possible. Alternatively, the fourth opening may be formed for each of the actuator unit 17. In such a case, the fourth opening is preferably formed in a position nearby the upper base of the actuator unit 17.

The third opening may be modified to any shape, size, or arrangement. For example, the shape and size of the third opening may be different from those of the second opening. Further, the position of the third opening is not particularly limited as long as the third opening is on the surface of the first plate, within the fix area of the actuator unit. For example, the third opening may be positioned along one side of the trapezoid shape of the opening group 160, instead of forming the third opening to surround the opening group 16G.

The holes structuring the liquid passages, which are provided to the plates 12*a* to 12*i* of the passage unit 12, may be in the form of recesses and are not limited to through holes.

Each actuator of the actuator unit is not limited to a piezoelectric actuator, and may be, for example, a heat generating element used in a thermal method, or an element used in an electrostatic method.

The application of the liquid ejecting head of the present invention is not limited to a printer. The liquid ejection head of the present invention is applicable to facsimile machines, photocopiers, and the like. Further, the liquid ejecting head of the present invention may eject a liquid other than ink.

The recording medium is not limited to the paper sheet P, as long as recording is possible. For example, the recording medium may be a piece of fabric or the like.

While this invention has been described in conjunction with the specific embodiments outlined above, it is evident that many alternatives, modifications and variations will be apparent to those skilled in the art. Accordingly, the preferred embodiments of the invention as set forth above are intended to be illustrative, not limiting. Various changes may be made without departing from the spirit and scope of the invention as defined in the following claims.

What is claimed is:

1. A liquid ejecting head comprising a passage unit and an actuator unit; wherein:

the passage unit includes:

a plurality of liquid passages each of which contains a first opening for ejecting liquid and a pressure chamber connected to the first opening; and a surface having a plurality of second openings by which the pressure chambers are exposed;

the actuator unit is fixed to the surface of the passage unit with a binder and covers the second openings, the actuator unit containing a plurality of actuators which face the second openings and apply ejection energy to the liquid inside the pressure chambers, respectively;

the passage unit includes a plurality of plates which are stacked one another and have holes structuring the liquid passages;

of the plates, a first plate having the surface of the passage unit, and at least another plate adjacent to the first plate, have a dummy passage which is not in communication with the liquid passages; and one end of the dummy passage extends from and is connected to one or more third openings formed within a fix area of the actuator unit on the surface of the first plate, and an other end of the dummy passage is connected to one or more fourth openings formed on a surface of any of the plates, via a space formed in a plate other than the first plate, the dummy passage being opened to the atmosphere through the one or more fourth openings.

2. The liquid ejecting head according to claim 1, wherein the third openings are positioned along a periphery of the fix area, outside an opening group constituted by the second openings formed within the fix area.

3. The liquid ejecting head according to claim 2, wherein the third openings surround the opening group along the periphery of the fix area.

4. The liquid ejecting head according to claim 3, wherein the third openings have the same size and shape as those of the second openings, and the positional relation among any one of the third openings, the second openings, and the other third openings is the same as the positional relation among the second openings in the opening group.

5. The liquid ejecting head according to claim 1, wherein the fourth opening is formed on the surface of the first plate.

6. The liquid ejecting head according to claim 1, wherein the passage unit includes an inspection passage between the liquid passages, the inspection passage being in communication with the dummy passage but not in communication with the liquid passages.

7. The liquid ejecting head according to claim 1, wherein the fourth openings sandwich the liquid passages, when viewed from a direction perpendicular to the surface.

8. The liquid ejecting head according to claim 1, wherein the dummy passage includes: a first portion extending from the third opening through the first plate and at least one of the plates adjacent to the first plate, in a direction crossing the surface; and a second portion formed on a surface of a second plate which is the thickest plate among the plates in which the first portion is formed, the second portion extending along the surface of the second plate from an end of the first portion opposite to an end connecting to the third opening.

9. The liquid ejecting head according to claim 8, wherein the surface of the second plate is opposite to the first plate.

10. The liquid ejecting head according to claim 1, wherein:

a to-atmosphere ventilation groove is formed outside and along the periphery of the fix area, on the surface of the first plate; and the third openings are connected to the to-atmosphere ventilation groove.

* * * * *